US009538282B2

(12) United States Patent
DeLay et al.

(10) Patent No.: US 9,538,282 B2
(45) Date of Patent: Jan. 3, 2017

(54) ACOUSTICALLY TRANSPARENT WAVEGUIDE

(71) Applicant: Robert Bosch GmbH, Stuttgart (DE)

(72) Inventors: Mark Thomas DeLay, Saint Paul, MN (US); David Edward Carlson, Savage, MN (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/584,517

(22) Filed: Dec. 29, 2014

(65) Prior Publication Data

US 2016/0192062 A1 Jun. 30, 2016

(51) Int. Cl.

| | |
|---|---|
| ***H04R 7/00*** | (2006.01) |
| ***H04R 1/20*** | (2006.01) |
| ***G10K 13/00*** | (2006.01) |
| ***H04R 1/24*** | (2006.01) |
| *H04R 1/26* | (2006.01) |
| *H04R 1/30* | (2006.01) |

(52) U.S. Cl.
CPC ..... *H04R 1/20* (2013.01); *G10K 13/00* (2013.01); *H04R 1/24* (2013.01); *H04R 1/26* (2013.01); *H04R 1/30* (2013.01)

(58) Field of Classification Search
CPC ..... H04R 1/345
USPC ..... 181/184
See application file for complete search history.

(56) References Cited

U.S. PATENT DOCUMENTS

| | | | | |
|---|---|---|---|---|
| 1,771,052 | A * | 7/1930 | Mallory | 181/184 |
| 1,840,992 | A * | 1/1932 | Weitling | 181/184 |
| 3,174,578 | A * | 3/1965 | Kojima | 181/184 |
| 4,619,342 | A * | 10/1986 | Buck | 181/184 |
| 5,115,883 | A * | 5/1992 | Morikawa et al. | 181/152 |
| 5,137,110 | A * | 8/1992 | Bedard et al. | 181/153 |
| 5,233,136 | A * | 8/1993 | Hamada | 181/152 |
| 5,945,642 | A * | 8/1999 | Nayar et al. | 181/184 |
| 6,116,373 | A * | 9/2000 | Dodd | 181/152 |

(Continued)

FOREIGN PATENT DOCUMENTS

| | | |
|---|---|---|
| EP | 2814262 | 12/2014 |
| WO | 9419915 | 9/1994 |

OTHER PUBLICATIONS

Harman Professional, "PD700 Series," http://www.jblpro.com/www/products/installed-sound/pd700-series, dated Aug. 28, 2001, (1 page).

(Continued)

*Primary Examiner* — Forrest M Phillips

(74) *Attorney, Agent, or Firm* — Michael Best & Friedrich LLP

(57) ABSTRACT

The invention provides a high-frequency acoustic waveguide for use in coaxial loudspeaker systems. The waveguide is made up of a plurality of walls that define a conduit with an input end and an output end. Each of the walls includes a mask layer and a perforation layer. The mask layer has a plurality of holes sized and shaped to make the mask layer acoustically transparent to sound waves below a crossover frequency. The perforation layer has a plurality of micro-perforations sized and shaped to make the perforation layer acoustically opaque to sound waves above the crossover frequency. The waveguide directs sound waves above the crossover frequency, and is acoustically transparent to sound waves below the crossover frequency.

14 Claims, 6 Drawing Sheets

(56) References Cited

U.S. PATENT DOCUMENTS

| | | | | |
|---|---|---|---|---|
| 6,628,796 | B2 | 9/2003 | Adamson | |
| 6,950,530 | B2 | 9/2005 | Baird et al. | |
| 7,236,606 | B2 | 6/2007 | Werner | |
| 7,280,665 | B2 | 10/2007 | Tamura et al. | |
| 7,920,712 | B2 | 4/2011 | Butler | |
| 8,130,994 | B2 | 3/2012 | Button et al. | |
| 8,139,784 | B2 | 3/2012 | Oclee-Brown | |
| 8,284,976 | B2 * | 10/2012 | Danley | 381/342 |
| 2002/0014369 | A1 * | 2/2002 | Engebretson | 181/199 |
| 2003/0132056 | A1 * | 7/2003 | Meyer et al. | 181/187 |
| 2003/0133581 | A1 | 7/2003 | Klayman | |
| 2004/0252856 | A1 | 12/2004 | Masuda | |
| 2005/0271236 | A1 | 12/2005 | Kobayashi et al. | |
| 2006/0023903 | A1 | 2/2006 | Hayashi et al. | |
| 2006/0285712 | A1 | 12/2006 | Butler | |
| 2012/0201403 | A1 | 8/2012 | Tan | |
| 2012/0247866 | A1 * | 10/2012 | Lage | 181/196 |
| 2012/0269379 | A1 | 10/2012 | Gao et al. | |
| 2013/0064414 | A1 * | 3/2013 | Flavignard et al. | 381/412 |

OTHER PUBLICATIONS

Next Proaudio Naturally, "Professional Audio Products," brochure, dated Mar. 20, 2012, Portugal (4 pages).
Extended European Search Report for Application No. 15195371 dated May 6, 2016 (8 pages).

* cited by examiner

ACOUSTICALLY TRANSPARENT WAVEGUIDE

BACKGROUND

The present invention relates to the use of acoustical waveguides in multi-way coaxial loudspeakers.

SUMMARY

A waveguide, sometimes referred to as a horn, has two purposes. The first purpose is to confine the sound radiated by a transducer coupled to the waveguide to precise horizontal and vertical angles. The second purpose is to more efficiently transmit the sound from the transducer into the listening space, thus making it louder.

Many loudspeaker applications require the delivery of wide bandwidth signals, confined to a specific area. To deliver wide bandwidth signals originating from one position, coaxial loudspeaker systems are often used. Coaxial loudspeakers include two frequency band sections—a low-frequency band section and a high-frequency band section, with the high-frequency section mounted coaxially within the low-frequency section. The low-frequency section transmits sound below a crossover frequency, and the high-frequency section transmits sound above the crossover frequency. Waveguides are used to precisely control the sound pattern radiating from the loudspeakers and confine the sound to the listening area. However, a coaxial design has a disadvantage in that the smaller high-frequency section presents an obstruction to low-frequency section. The obstruction changes how the sound radiates from the low-frequency section, resulting in the sound coverage being uneven off axis. Thus, listeners positioned directly in front of the loudspeaker hear one thing, but listeners positioned off to the sides hear something different.

This presents two problems. First, not every listener in the audience hears the same audio quality. Second, spoken words coming through the loudspeakers may not be intelligible to every listener in the audience. A listener in the audience will not only hear the sound radiating directly from the loudspeaker, but will also hear the sound that reflects off the floor, walls, and ceiling. The reflected sound causes echoes and reverberations that make it hard to understand speech and other sound content. In a coaxial loudspeaker system, the obstruction created by the high-frequency section disrupts the sound traveling through low-frequency section. This disruption makes the sound radiation from the lower-frequency section inconsistent; thus decreasing intelligibility.

Prior art systems include waveguides having large holes in them to allow sound from the lower-frequency section to pass through the high-frequency waveguide, making the high-frequency wave guide less of an obstruction. However, the larger holes also allow sound from the high-frequency transducer to leak out of the high-frequency waveguide, seriously compromising the performance of the high-frequency section.

The present invention minimizes the obstruction footprint by making the high-frequency waveguide substantially acoustically transparent to low-frequency sound waves, while minimizing the degradation of the performance of the high-frequency section.

In one embodiment, the invention provides a high-frequency acoustic waveguide for use in coaxial loudspeaker systems. The waveguide is made up of a plurality of walls that define a conduit with an input end and an output end.

Each of the walls includes a mask layer and a perforation layer. The mask layer has a plurality of openings sized and shaped to make the mask layer acoustically transparent to sound waves below a crossover frequency. The perforation layer has a plurality of micro-perforations sized and shaped to make the perforation layer acoustically opaque to sound waves above the crossover frequency and acoustically transparent to sound waves below the crossover frequency. The waveguide directs sound waves above the crossover frequency, and is acoustically transparent to sound waves below the crossover frequency.

In some embodiments of the invention, the perforation layer is positioned on an inner surface of the mask and covers the plurality of openings in the mask.

In some embodiments of the invention, the perforation layer is positioned on an outer surface of the mask and covers the plurality of openings in the mask.

In some embodiments of the invention, the perforation layer is made up multiple micro-perf screens, and each of the screens is positioned to cover one of the openings in the mask layer. The multiple screens can be positioned on either the inner surface or the outer surface of the mask layer.

In other embodiments of the invention, the perforation layer is integrated into the mask layer, such that the mask and the perforation layer are a single component.

In another embodiment the invention provides a coaxial loudspeaker system. The system includes a low-frequency section and a high-frequency section. The low-frequency section has at least one low-frequency transducer coupled to a low-frequency waveguide. The low-frequency transducer emits sound at frequencies below a crossover frequency. The high-frequency section has a plurality of walls that define a conduit with an input end and an output end. Each of the walls includes a mask layer and a perforation layer. The mask layer has a plurality of holes sized and shaped to make the mask layer acoustically transparent to sound waves below a crossover frequency. The perforation layer has a plurality of micro-perforations sized and shaped to make the perforation layer acoustically opaque to sound waves above the crossover frequency and acoustically transparent to sound waves below the crossover frequency. The high-frequency section is positioned within the low-frequency section, and the high-frequency waveguide directs sound waves above the crossover frequency, and is acoustically transparent to sound waves below the crossover frequency.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
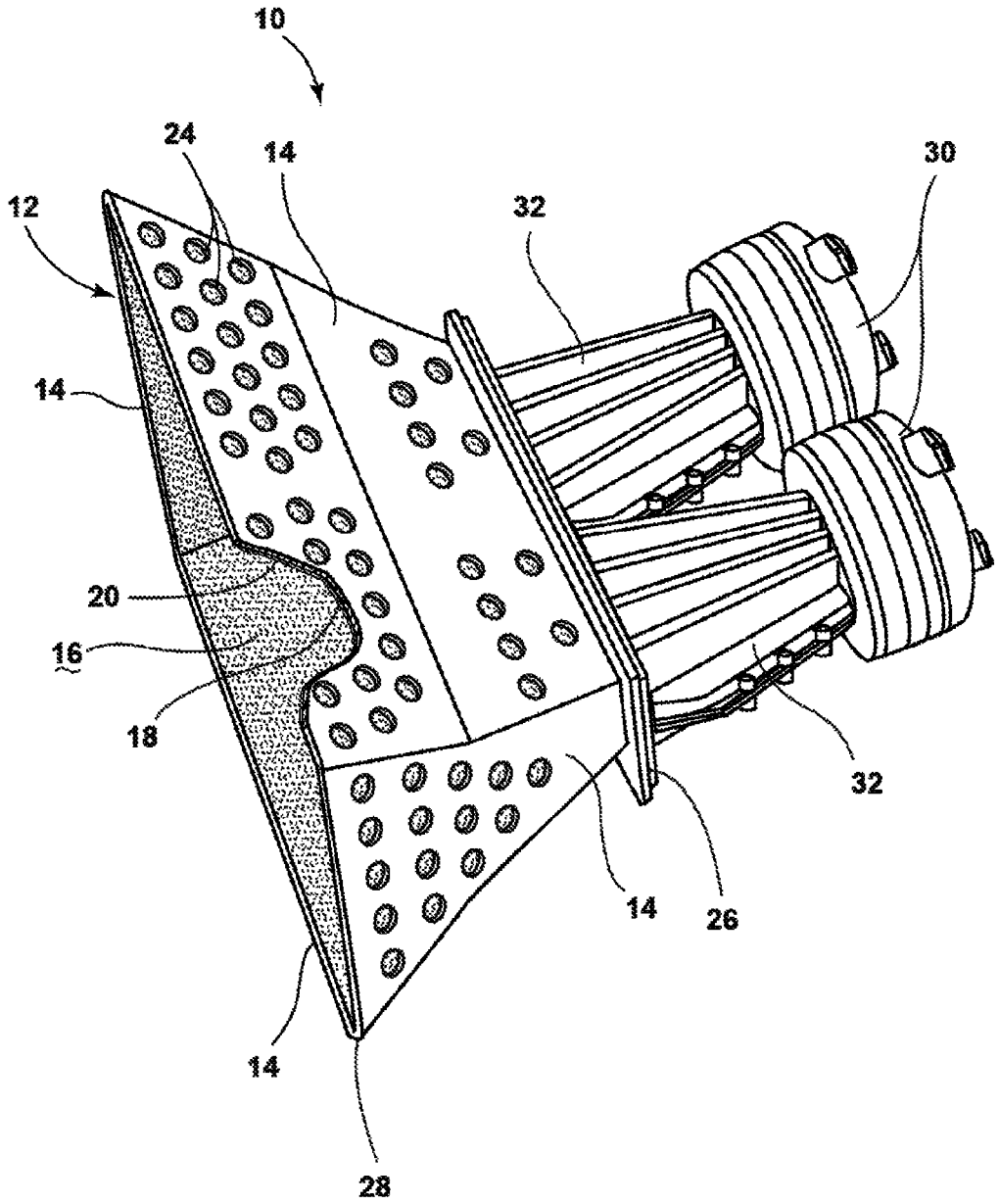
FIG. 1 illustrates a high-frequency loudspeaker section for a coaxial loudspeaker.

FIG. 1 illustrates a high-frequency loudspeaker section 10. The high-frequency loudspeaker section 10 includes a high-frequency waveguide 12. The high-frequency waveguide 12 includes four walls 14 arranged to form a conduit 16. Each of the walls 14 includes a mask layer 18 and a perforation layer 20. The perforation layer 20 is positioned on the inner surface of the mask layer 18, inside of the conduit 16. In other embodiments, perforation layer 20 is mounted on the outer surface of mask layer 18, on the exterior of the conduit 16. The mask layer 18 has a plurality of openings 24. The mask layer can be made of metal, plastic, or another suitable material. The perforation layer 20 can be made or perforated sheet metal, or another suitable material. In FIG. 1, the perforation layer 20 is visible through the plurality of openings 24. The plurality of openings 24 can be other shapes and patterns than those illustrated in FIG. 1.

The high-frequency waveguide 12 has an input end 26, and an output end 28. The loudspeaker section 10 also includes two transducers 30, each one of which is coupled to one of two acoustic transformers 32. The acoustic transformers 32 are coupled to the input end 26. In other embodiments, a single transducer 30 is employed. In some embodiments, the transducers 30 are coupled directly to the high-frequency waveguide 12 without an acoustic transformer. The transducers 30 produce high-frequency sound waves, which travel through the acoustic transformers 32 and are received by the input end 26. The sound waves are guided by the waveguide boundary walls that define conduit 16, and emitted from the output end 28.

Figure 2:
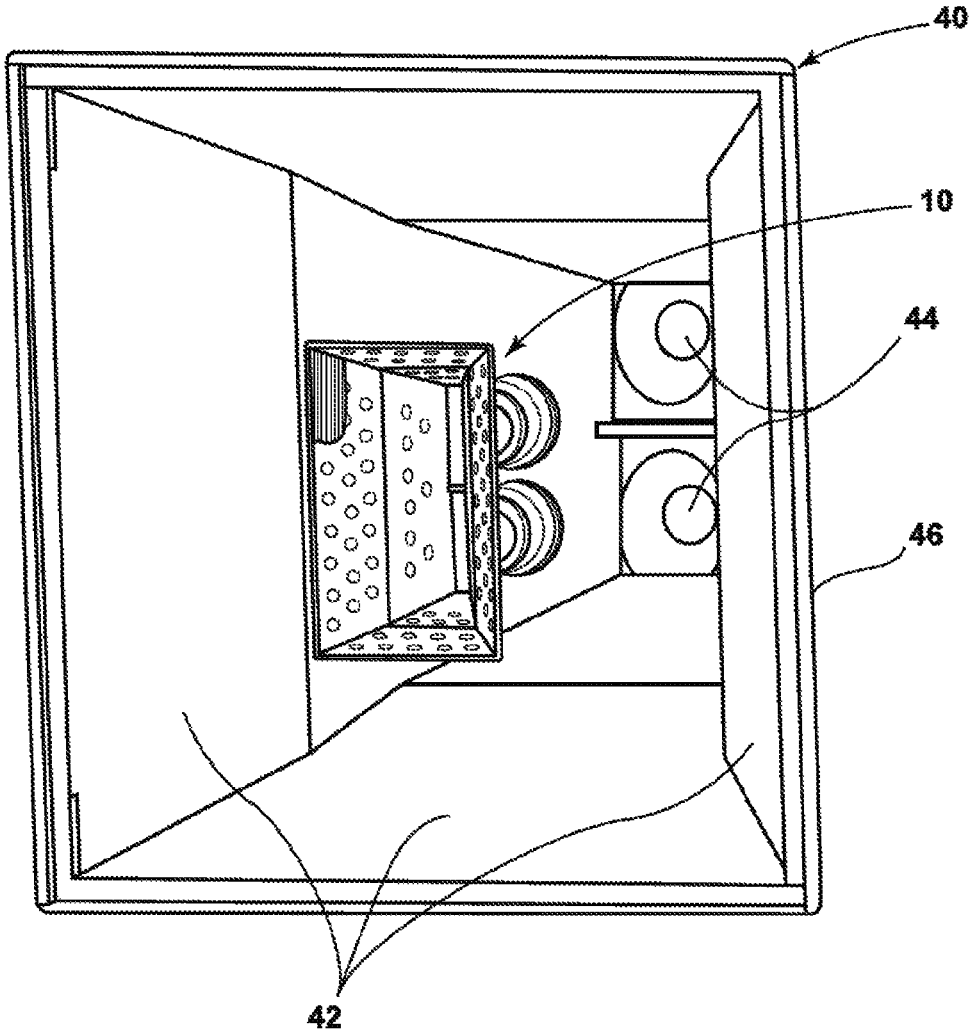
FIG. 2 illustrates the high-frequency loudspeaker section of FIG. 1 deployed in a coaxial loudspeaker system.

FIG. 2 illustrates a coaxial loudspeaker system 40. The coaxial loudspeaker system 40 includes the high-frequency loudspeaker section 10 of FIG. 1 and a low-frequency section 42. The low-frequency section 42 has two low-frequency transducers 44 and a low-frequency waveguide 46. The high-frequency loudspeaker section 10 is mounted coaxially within the low-frequency section 42. Loudspeaker system 40 operates using a cross-over frequency to divide sound waves between the two sections. The low-frequency transducers 44 emit sound waves below the crossover frequency, and the high-frequency transducers 30 emit sound waves above the crossover frequency.

Figure 3:
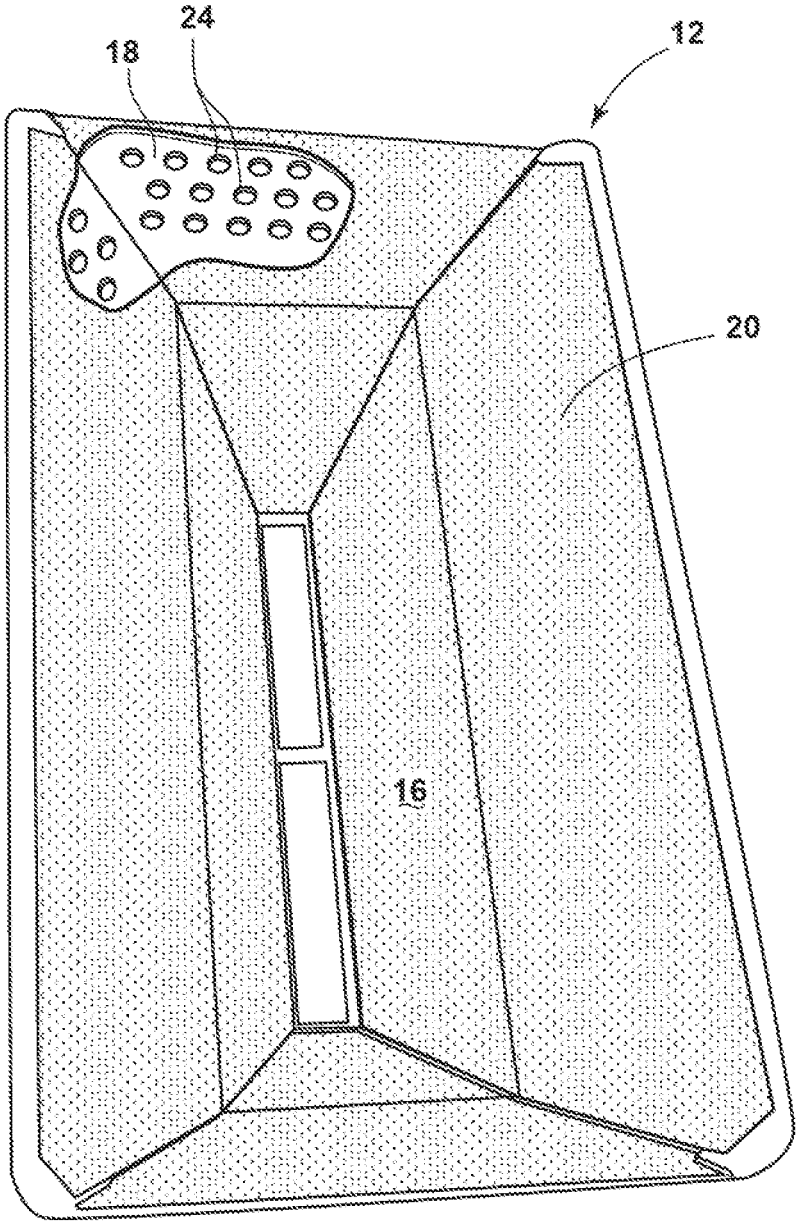
FIG. 3 is a perspective view of the front of the waveguide.
Figure 3A:
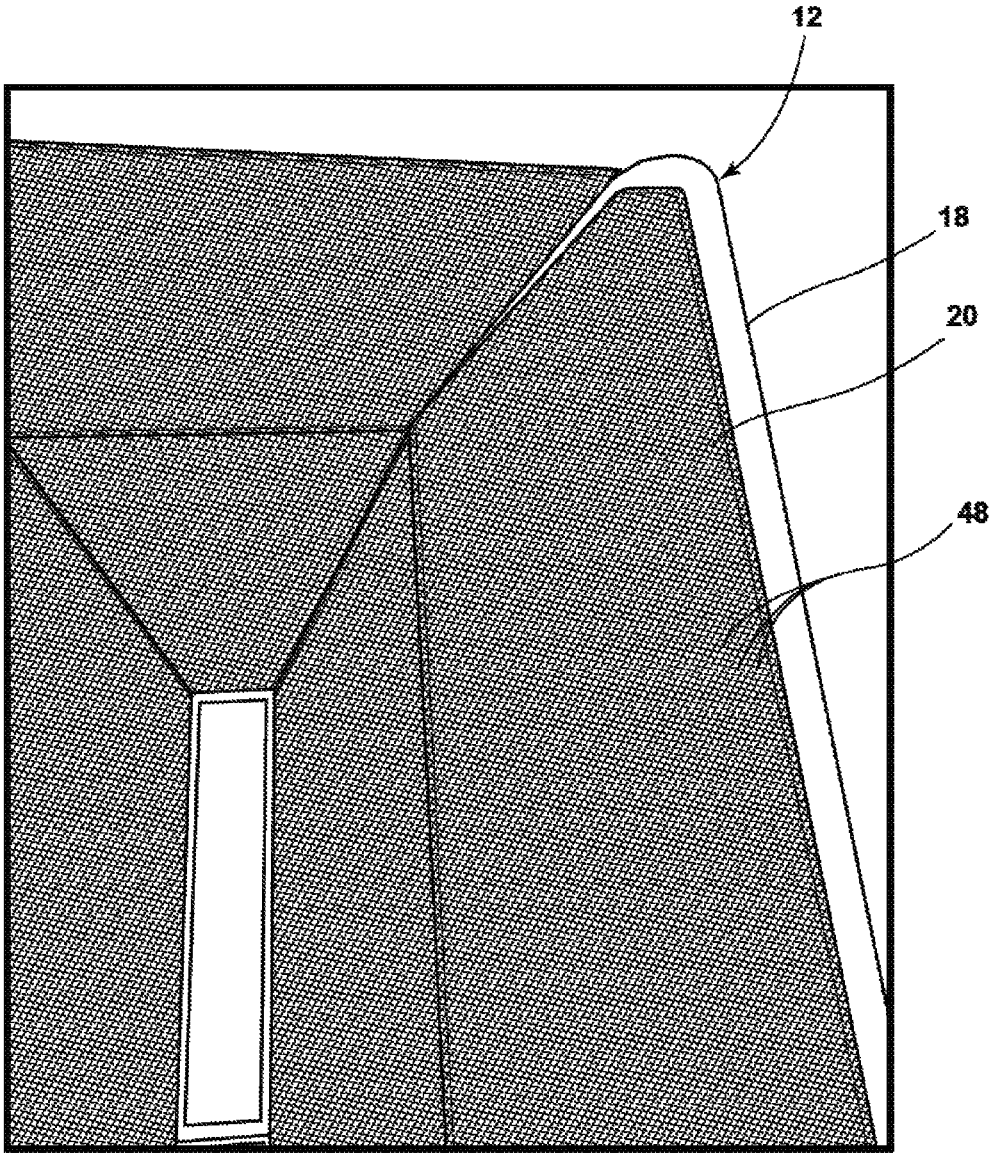
FIG. 3A is a detailed view of the front of the waveguide illustrated in FIG. 3.

FIG. 3 illustrates a perspective view of the front of the high-frequency waveguide 12. The perforation layer 20 is mounted on the inner surface of the mask layer 18, inside conduit 16, and covers the plurality of openings 24 in the mask layer 18. FIG. 3A illustrates a close up view of the front of the high-frequency waveguide 12. A plurality of micro-perforations 48 are visible in the perforation layer 20. The combination of the mask layer 18 and the perforation layer 20 allows the high-frequency waveguide 12 to direct sound waves above the crossover frequency, and be acoustically transparent to sound waves below the crossover frequency.

In some embodiments, the perforation layer 20 is made from perforated sheet metal. The open area is the ratio of the hole area in the screen to the solid area in the screen. No screen would have a 100% open area, and a solid sheet would have 0% open area. A screen with larger holes and larger open area typically allows sound to transmit through equally at both low and high frequencies. A screen with smaller holes and a smaller open area typically reduces sound transmission at high frequencies while allowing more sound to transmit through at low frequencies.

Perforated screen with smaller holes and smaller open area is often referred to as "micro-perf" or "micro-perforation". Micro-perf is sometimes employed in acoustic applications where reduced sound transmission at high frequencies is desired compared to low frequencies.

The present invention uses the difference in sound transmission of low and high frequencies to make the high-frequency waveguide 12 substantially transparent to low-frequency sound waves.

If the perforated screen transitioned from being acoustically opaque to acoustically transparent at a precise frequency, the entire high-frequency waveguide could be constructed from perforated screen by choosing perforated screen that had the appropriate acoustical properties. At higher frequencies, such a screen waveguide would appear to be a solid material. At the lower frequencies, the high-frequency screen waveguide would be nearly invisible to low-frequency sound. However, real-world perforated screens do not perform this way. Instead, they exhibit a gradual frequency transition. Some perforation manufacturers have optimized their hole perforation detail to make a less gradual transition, but the transition is still gradual. A waveguide, constructed entirely of a screen that passed all the low-frequency sound output, would leak too much sound from the high-frequency transducers, thus degrading the waveguide's performance. Similarly, a waveguide constructed entirely from a screen that did not leak any of the sound from the high-frequency transducers would act as a low-frequency obstruction, degrading the performance of the low-frequency sound. Therefore, the micro-perforation alone is inadequate as a waveguide.

Figure 4:
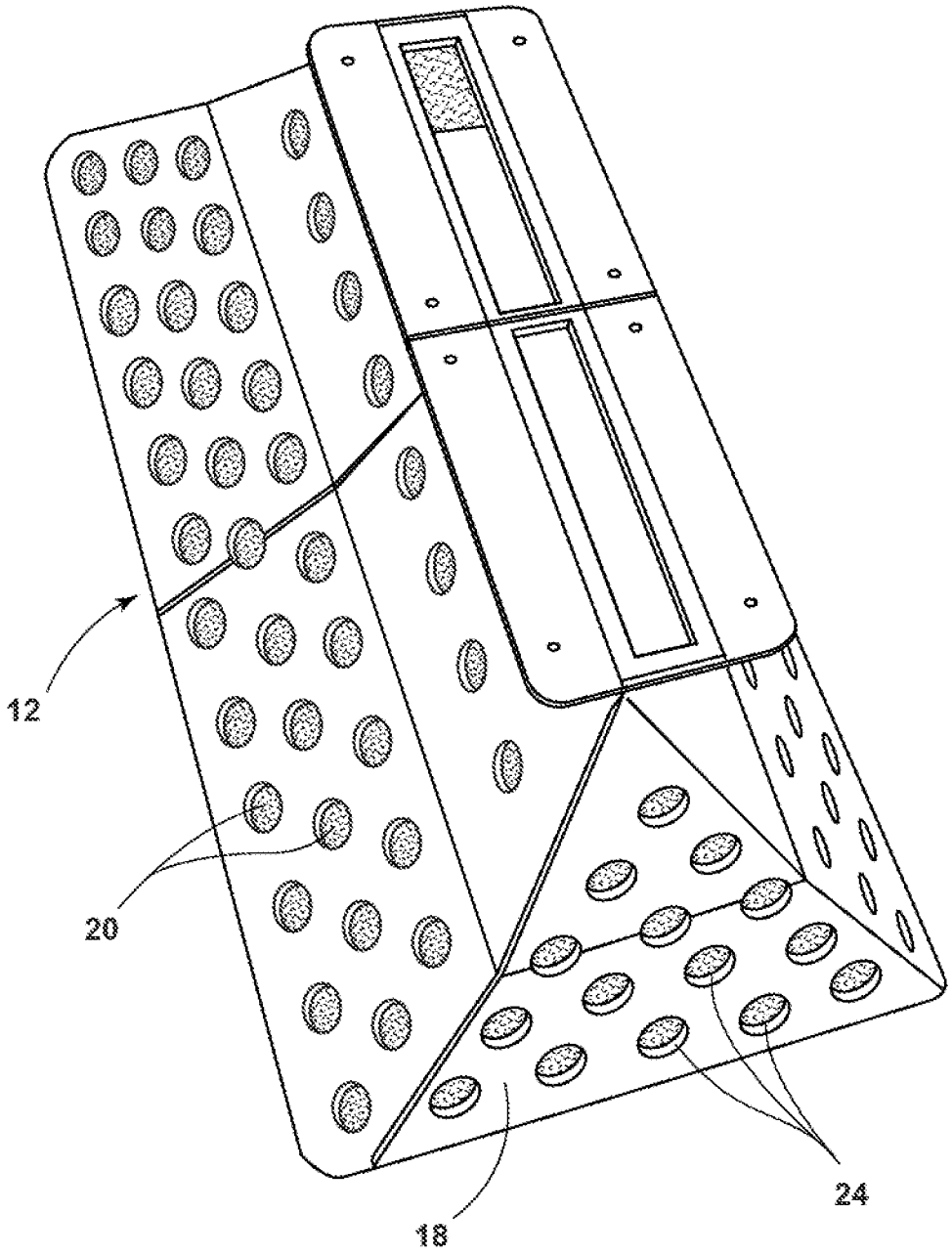
FIG. 4 is a perspective view of the rear of the waveguide.
Figure 4A:
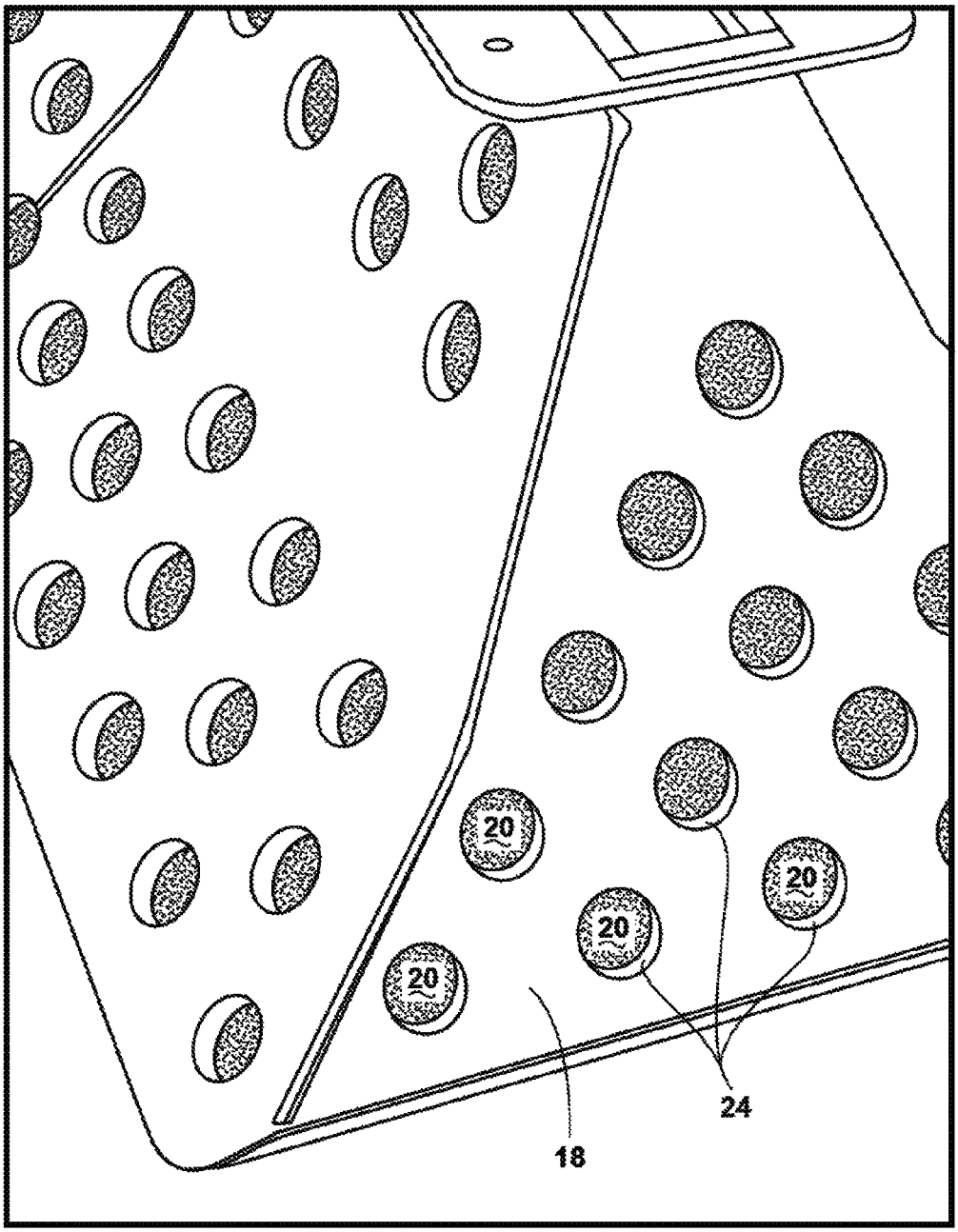
FIG. 4A is a detailed view of the rear of the waveguide illustrated in FIG. 4.

As illustrated in FIGS. 4 and 4A, exemplary embodiments of the present invention combine a micro-perf screen in a perforation layer 20 with a mask layer 18, which has openings 24. This maximizes the sound transmission of low frequencies through the high-frequency waveguide 12, while minimizing the leakage of high-frequency sound from the high-frequency transducers 30 through the high-frequency waveguide 12.

In prior art coaxial loudspeakers, the sound energy from the low-frequency transducers 44 that encounters the back side of the high-frequency waveguide 12 will not be constant throughout the low-frequency waveguide 46. The high-frequency waveguide 12 thus acts as an obstruction, which results in the sound pressure level distribution being unequal. By strategically introducing the openings 24 in the mask layer 18, and covering the openings 24 with the perforation layer 20, low-frequency sound passes through the high-frequency waveguide 12. This results in the low-frequency sound waves propagating from input to output of the low-frequency waveguide 46 as if the high-frequency waveguide 12 was not there. Likewise, the leakage of the high-frequency sound through the high-frequency waveguide 12 is minimized.

Because the sound transition from low to high frequencies is different with different micro-perforation designs, that transition is matched to the crossover frequency from the low-frequency section 42 to the high-frequency section 10 in the coaxial loudspeaker design. This can be accomplished by choosing an available perforation that has transition region characteristics that are close to the crossover frequency of the coaxial loudspeaker system 40. Shapes of the holes in the micro-perforation screen may be round, rectangular, triangular, trapezoidal, diamond or other shapes. Any perforation that exhibits the appropriate transition in low-to-high frequency transmission is suitable for use as a perforation layer 20.

The placement of the openings 24 in the mask layer 18 is highly geometry dependent. A coaxial loudspeaker system designed to have a 60-degree×40-degree sound radiation pattern will have waveguides with different geometry than a loudspeaker system designed to have a 40-degree×30-degree sound radiation pattern. Thus, the pattern of the openings in the mask layer is different for each loudspeaker system design. The loudspeaker system 40 in FIG. 2 has two low-frequency transducers 44 on a single low-frequency waveguide 46 and two high-frequency transducers 30 on a single high-frequency waveguide 12. A loudspeaker system with only one transducer on each waveguide would require a different pattern of openings in the mask layer.

As known to one skilled in the art, the high-frequency waveguide 12 can be considered to consist of a series cross-sectional areas from the input to the output. Different areas of the high-frequency waveguide 12 have a dominant effect on the performance of the high-frequency waveguide 12 in different frequency bands. Openings 24 in the mask layer 18 cause leaking of high-frequency sound energy, degrading the performance of the high-frequency waveguide 12. This degradation takes the form of a change in the frequency response of the high-frequency section 10, a change in the sound radiation pattern of the high-frequency waveguide 12, or both. For example, if too many openings 24 are made in a specific area of the mask layer 18 of the high-frequency waveguide 12, sound waves in the frequency band corresponding to that area will leak through. However, if that section does not have enough openings 24, it will make the high-frequency waveguide opaque to the low-frequency sound waves.

In another embodiment of the invention, the perforation layer 20 is made up of many small screens covering only the openings 24 with the perforation layer 20 (e.g., round disks of perforation installed in the openings 24). In another embodiment, the mask layer and perforation layer are formed from a single layer of material with groupings of small holes strategically placed in the material, mimicking the perforation-covered openings.

Thus, the invention provides, among other things, a high frequency waveguide, which is transparent to low-frequency sound waves, for mounting inside a low-frequency waveguide. Various features and advantages of the invention are set forth in the following claims.

What is claimed is:

1. A high-frequency acoustic waveguide for use in coaxial loudspeaker systems, the waveguide comprising:

a plurality of walls arranged as a rectangular frustum, the rectangular frustum having a single input end and a single output end, the plurality of walls including a mask layer and a perforation layer;

wherein the mask layer includes a plurality of openings sized and shaped to make the mask layer acoustically transparent to sound waves below a crossover frequency, the perforation layer has a plurality of micro-perforations sized and shaped to make the perforation layer acoustically opaque to sound waves above the crossover frequency, and the waveguide directs sound waves above the crossover frequency, and is acoustically transparent to sound waves below the crossover frequency.

2. The waveguide of claim 1, wherein the perforation layer is positioned on an inner surface of the mask layer and covers the plurality of openings.

3. The waveguide of claim 1, wherein the perforation layer is positioned on an outer surface of the mask layer and covers the plurality of openings.

4. The waveguide of claim 1, wherein the perforation layer includes a plurality of screens, each of the plurality of screens having a plurality of micro-perforations sized and shaped to make the screen acoustically opaque to sound waves above the crossover frequency, and each of the plurality of screens is positioned to cover one of the plurality of openings in the mask layer.

5. The waveguide of claim 4, wherein the plurality of screens are positioned on an inner surface of the mask layer.

6. The waveguide of claim 4, wherein the plurality of screens are positioned on an outer surface of the mask layer.

7. The waveguide of claim 1, wherein the mask layer and the perforation layer are formed from a single layer of material.

8. A coaxial loudspeaker system, the system comprising:

a low-frequency section having at least one low-frequency transducer coupled to a low-frequency waveguide, the at least one low-frequency transducer emitting sound at frequencies below a crossover frequency; and a high-frequency section including at least one high-frequency transducer emitting sound at frequencies above the crossover frequency;

a high-frequency waveguide having a plurality of walls arranged as a rectangular frustum, the rectangular frustum having a single input end and a single output end, the plurality of walls including a mask layer and a perforation layer, wherein the mask layer includes a plurality of openings sized and shaped to make the mask layer acoustically transparent to sound waves below the crossover frequency, the perforation layer has a plurality of micro-perforations sized and shaped to make the perforation layer acoustically opaque to sound waves above the crossover frequency;

wherein the at least one high-frequency transducer is coupled to the high-frequency waveguide;

wherein the high-frequency section is positioned coaxially within the low-frequency section, the high-frequency waveguide directs sound waves above the crossover frequency, and is acoustically transparent to sound waves below the crossover frequency.

9. The system of claim 8, wherein the perforation layer is positioned on an inner surface of the mask layer and covers the plurality of openings.

10. The system of claim 8, wherein the perforation layer is positioned on an outer surface of the mask layer and covers the plurality of openings.

11. The system of claim 8, wherein the perforation layer includes a plurality of screens, each of the plurality of screens having a plurality of micro-perforations sized and shaped to make the screen acoustically opaque to sound waves above the crossover frequency, and each of the plurality of screens is positioned to cover one of the plurality of openings in the mask layer.

12. The system of claim 11, wherein the plurality of screens are positioned on an inner surface of the mask layer.

13. The system of claim 11, wherein the plurality of screens are positioned on an outer surface of the mask layer.

14. The system of claim 8, wherein the mask layer and the perforation layer are formed from a single layer of material.

* * * * *